US007137930B1

(12) United States Patent
Carr

(10) Patent No.: US 7,137,930 B1
(45) Date of Patent: Nov. 21, 2006

(54) FOREARM/WRIST CURL EXERCISE DEVICE

(75) Inventor: John Patrick Carr, 124 Hope La., Highland Heights, KY (US) 41076

(73) Assignee: John Patrick Carr, Highland Heights, KY (US)

( * ) Notice: Subject to any disclaimer, the term of this patent is extended or adjusted under 35 U.S.C. 154(b) by 138 days.

(21) Appl. No.: 11/016,122

(22) Filed: Dec. 17, 2004

Related U.S. Application Data

(60) Provisional application No. 60/539,084, filed on Jan. 26, 2004.

(51) Int. Cl.
*A63B 21/072* (2006.01)

(52) U.S. Cl. ..... 482/98; 482/50; 482/97; 482/139

(58) Field of Classification Search ..... 482/44, 482/46, 49, 50, 93, 94, 97, 98, 104–109, 482/139, 140; D21/681–682, 679
See application file for complete search history.

(56) References Cited

U.S. PATENT DOCUMENTS 4,252,316 A * 2/1981 Price ..... 482/106
4,345,756 A * 8/1982 Hoagland ..... 482/109
4,863,158 A * 9/1989 Tassone ..... 482/140
5,207,624 A * 5/1993 Paskovich ..... 482/93
5,720,695 A * 2/1998 Eckmann ..... 482/72
5,967,948 A * 10/1999 Carr ..... 482/93
6,171,221 B1 * 1/2001 Hayduk ..... 482/139
6,196,951 B1 * 3/2001 Shepherd ..... 482/106
6,338,702 B1 * 1/2002 Jordan ..... 482/108
6,485,399 B1 * 11/2002 Greene ..... 482/106
6,991,591 B1 * 1/2006 Tsatsouline ..... 482/140
7,048,674 B1 * 5/2006 Hartman et al. ..... 482/46
2004/0063553 A1 * 4/2004 Viscount ..... 482/107

* cited by examiner

*Primary Examiner*—Jerome Donnelly
*Assistant Examiner*—Victor K. Hwang

(57) ABSTRACT

An improved adjustable weight training apparatus is provided. The weight training apparatus includes a central collar portion, that further includes one or more elongated handles. In addition, each handle includes a gripping portion and a connecting end that attaches to a corresponding end of the central collar. Additionally each handle includes gripping protrusions that attach to a corresponding end of the elongated handles. The weight training apparatus further includes an angled weight support attachment that is received into the central collar and secured by a retaining pin or other similar device. In one preferred embodiment the angled weight support attachment may be pivoted and secured in a substantially upward position or in a substantially downward position. Weights may be retained by a sliding collar or similar means on the angled weight support attachment.

4 Claims, 7 Drawing Sheets

FOREARM/WRIST CURL EXERCISE DEVICE

CROSS REFERENCE TO RELATED APPLICATIONS

This application is based on provisional application Ser. No. 60/539,084, filed on Jan. 26, 2004.

STATEMENT REGARDING FEDERALLY SPONSORED RESEARCH OR DEVELOPMENT

Not Applicable.

REFERENCES CITED

U.S. Patent Documents

U.S. Pat. No. 5,967,948 Oct. 19, 1999 Carr . . . 482/93; 482/106

TECHNICAL FIELD

The present invention relates generally to weight training apparatus, and is particularly directed to a new and improved weight training apparatus that is designed to target different muscle groups of the forearms and wrists flexors and that carries weights in such a manner as to promote exercise efficiency.

BACKGROUND OF INVENTION

In addition to more elaborate weightlifting equipment comprising or including a plurality of levers, pulleys, weight plates, weights tethered to an elongated handle and various types of mechanical linkages, the traditional weightlifting apparatus has been and still remains a single, straight elongated bar fitted with collars near the ends thereof to retain weighted plates on the bar. A typical free-weight exercising barbell may consist of a pair of substantially equal weights spaced apart near the opposite ends of the bar. The center of gravity of a typical barbell is generally located somewhere along the axis of the gripping bar, usually at the midpoint. The standard straight bar has been widely used for many years for a variety of weightlifting exercises, including, by way of example, military and bench presses, curls, upright and bent-over rows and forearm/wrist curls.

During a typical set for a given exercise, an individual performs a series of repetitions by lifting the barbell between lower and upper positions so that targeted muscles will be stressed. The movement of the gripping hands, depending on the exercise, will generally be along a path having a large vertical component. Some exercises, upright rows for example, require substantially straight up and down motion of the barbell. Other exercises, such as curls, require the hands to move along a somewhat arcuate path having both horizontal and vertical components.

One common exercise done with a free-weight barbell is the forearm curl during which an exerciser may sit with the forearms braced on the exercisers upper front thighs with the wrist suspended over the exerciser's knees, the exerciser may use either a supine or pronated grip when grasping the barbell. Upon executing the curl, the exerciser's gripping hands may move along an arcuate path around the wrist in order to stress the forearms. During one forearm curl repetition, the upper arms will preferably be kept generally aligned with the exerciser's upper thighs. In the lowered position, the wrists are substantially at a 45 degree angle. To raise the barbell from the lowered position, the exerciser flexes at his wrist upwards, while the upper arms generally remain braced on the exerciser's thigh.

Another common device used to target the forearms and wrist flexors consist of an elongated bar wherein the weight is attached to a rope. The exerciser rolls the weight up using a twisting motion in order to stress the forearm muscles and wrist flexors.

Although standard barbells are useful for exercising targeted muscle groups, the standard barbell exhibits a number of shortcomings. For example, because the weight lies on the same plane as the gripping hands tension is greatly reduced at or about three quarters into the upward motion of the forearm curl. In order to better stress the muscles of the forearms and wrist a weight that is placed on an angled plane that is opposed to the gripping hands will maintain continuous tension through the full range of motion and promote exercise efficiency. Another disadvantage of standard barbells is that they do not allow the exerciser to change the angle of the gripping hands in order to stress the muscles from different angles.

Although the weight tethered to an elongated handle is useful for exercising the targeted muscles it exhibits a number of short comings. For example the twisting motion used to roll up the tethered weight limits the range of motion and applies undue stress on the wrist when used with a supine grip.

SUMMARY OF THE INVENTION

Accordingly, it is a primary object of the present invention to provide an improved forearm weight training apparatus that places the weight on a plane opposed to the gripping hands and to promote continuous tension on the muscles of the forearms and wrist flexors substantially throughout their full ranges of motion.

Another object of the present invention is to provide an improved weight training apparatus that allows the user to select from a number of different angles of weight placement to promote exercise efficiency. Another object of the present invention is to also provide the exerciser with an ergonomic grip that is more like the exercisers natural grip.

Another object of the present invention is to also provide the exerciser with a number of gripping options to promote exercise efficiency.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention an improved Adjustable Forearm/Wrist Curl Exercise Device is provided.

The weight training apparatus includes a central collar portion, that further includes one or more elongated handles. In addition, each handle includes a gripping portion and a connecting end that attaches to a corresponding end of the central collar. Additionally each handle includes gripping protrusions that attach to a corresponding end of the elongated handles. The weight training apparatus further includes an angled weight support attachment that is received into the central collar and secured by a retaining pin or other similar device.

In one preferred embodiment the angled weight support attachment may be pivoted and secured in a substantially upward position or in a substantially downward position.

Weights may be retained by a sliding collar or similar means on the angled weight support attachment.

In second preferred embodiment the angled weight support attachment may be pivoted in a substantially upward position or in a substantially downward position and retained in the central collar by shaft collars or other similar device. Weights may be retained by a sliding collar or similar means on the angled weight support attachment.

In a second preferred embodiment, the elongated handles may be provided with cylindrical protrusions to allow exerciser to grip apparatus with the palms of the hands aligned vertically.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without department from the invention. Accordingly, the drawings and descriptions will be regarded as illustrative in nature and not as restrictive.

BRIEF DESCRIPTION OF THE DRAWINGS

The accompanying drawing incorporated in and forming a part of the specification illustrate several aspects of the present invention and together with the description and claims serve to explain the principles of the invention. In the drawings:

DETAILED DESCRIPTION OF THE PREFERRED EMBODIMENT

Figure 1:
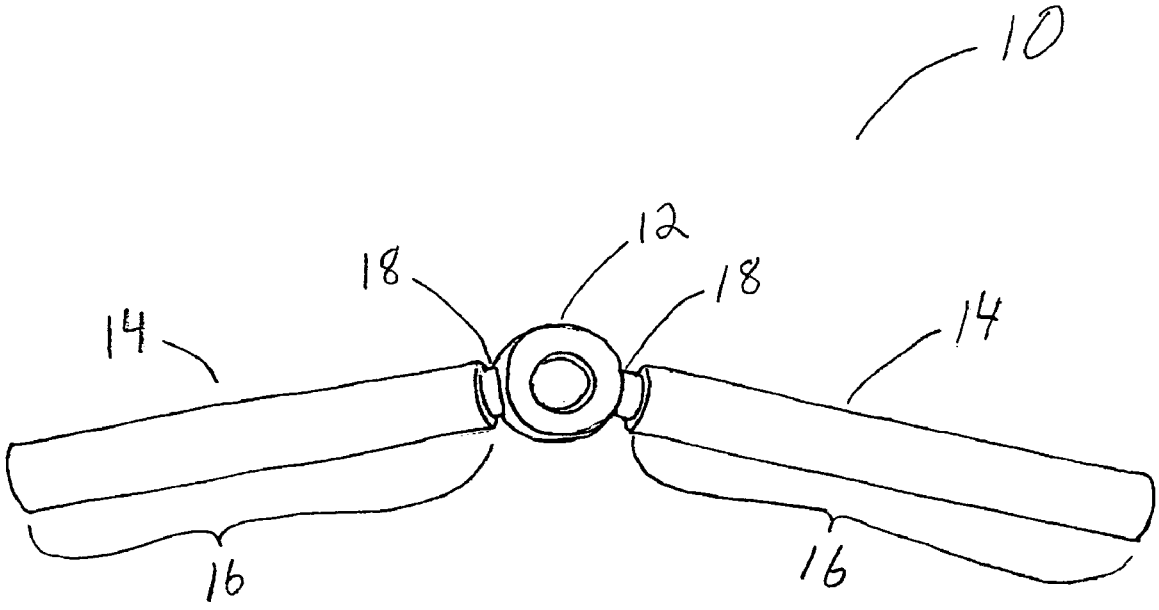
FIG. 1 is a perspective view of the weightlifting apparatus of the present invention with 7-degree angled handles installed thereon.
Figure 2:
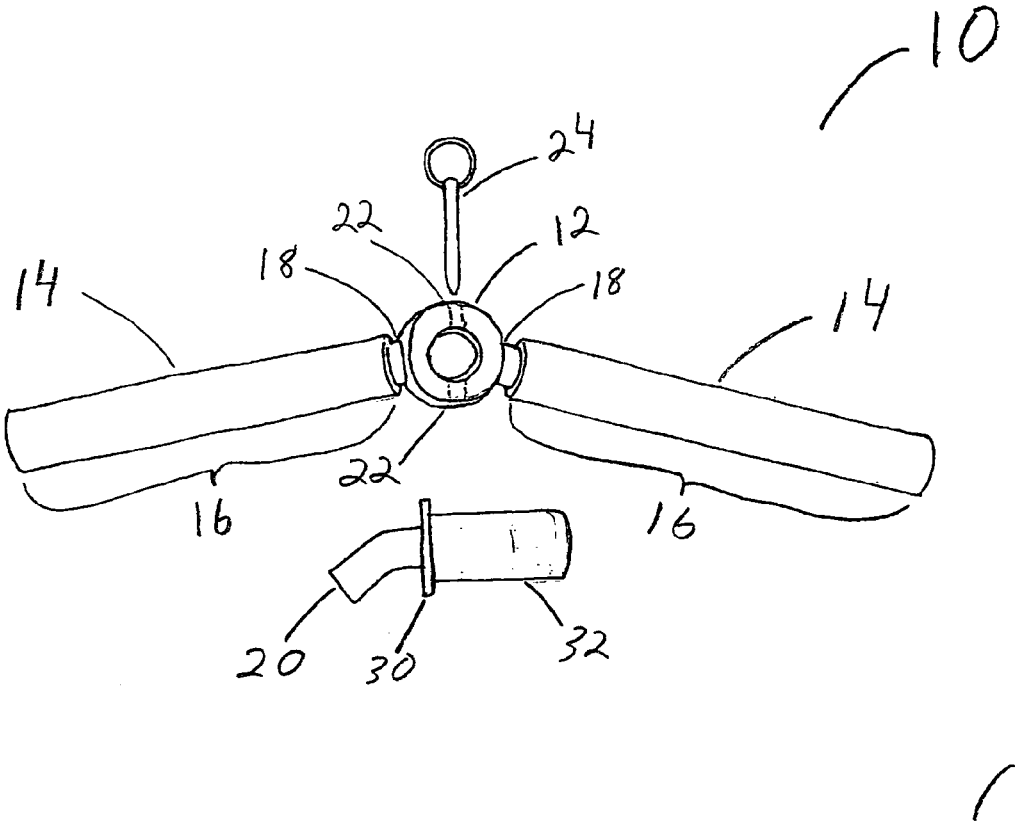
FIG. 2 is a perspective view of the weightlifting apparatus of the present invention with 35 degree angled weight support attachment.
Figure 3:
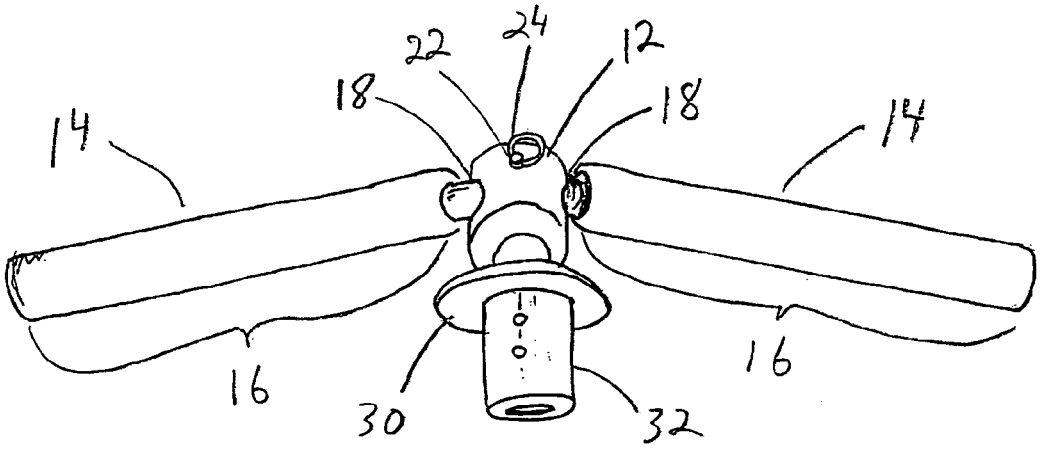
FIG. 3 is a perspective view of the weightlifting apparatus of the present invention with 35 degree angled weight support attachment installed thereon.

Reference will now be made in detail to the present preferred embodiment of the invention, an example of which is illustrated in the accompanying drawings, wherein like numerals indicate the same elements throughout the views. Referring now to the drawings, FIG. 1 shows the weight training apparatus of the present invention, generally designed by the numeral 10. Preferably, the weightlifting apparatus 10 includes a central collar portion 12, As shown in FIGS. 1–3, the weightlifting apparatus 10 of the present invention further includes one or more elongated handles 14. Preferably, the weightlifting apparatus 10 comprises two such handles 14 angled at seven degrees. Each handle 14 comprises a gripping portion 16, which a user may grasp during use of the weight training apparatus. The gripping portion 16 may be knurled or textured to provide greater friction to prevent slippage during use. Additionally, gripping portion 16 may include contours or other ergonomic indentations or protrusions to enable a user to grip the handles 16 with increased comfort and stability. Foam grips or other similar devices may also be employed to add greater comfort and stability for the user. The handles 14 further comprise a connecting end portion 18 that is adapted to be attached to a corresponding end of the central collar 12. Obviously, there are several methods of attaching the handles 14, to the central collar 12, such as welding, casting the components as one integral piece, linking the various members with threaded connectors or any other suitable manner as known in the art.

Preferably, the handles 14, are comprised of a steel bar having a circular cross-section and an outer diameter of about 1 inch and similar to the steel bars employed as weightlifting bars in the prior art. As is typical, it is preferable that the various framework components of the weight training apparatus 10 may be comprised of substantially any material exhibiting the necessary strength and durability.

Figure 6:
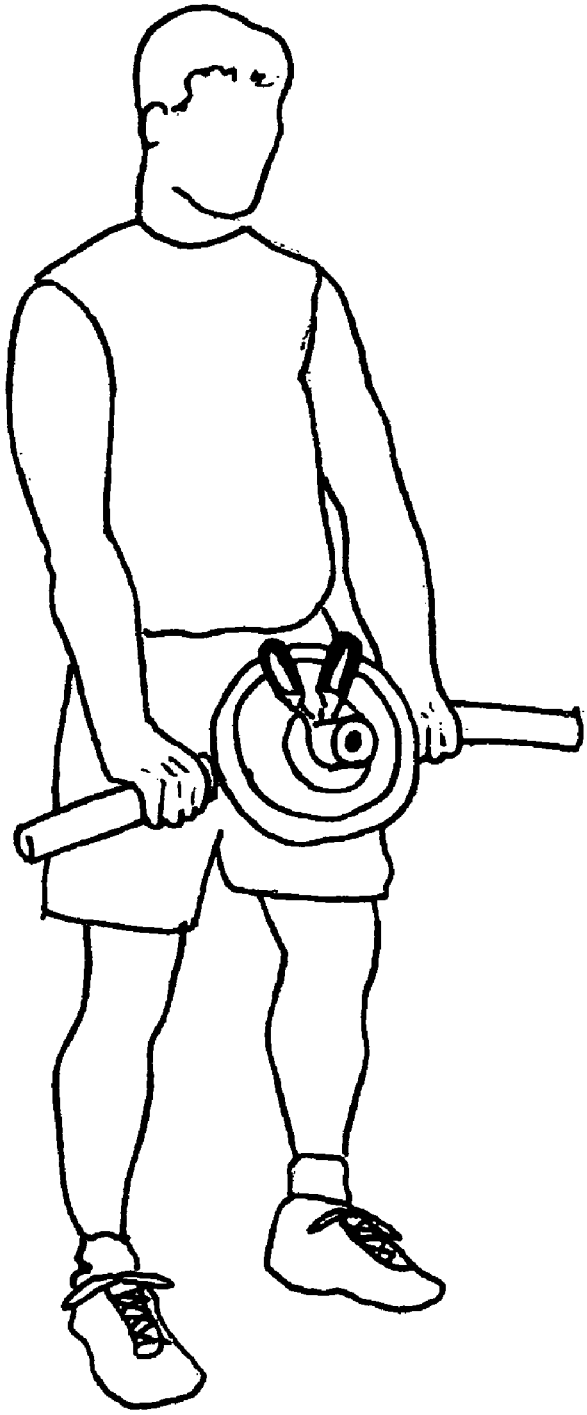
FIG. 6 is a perspective view showing a user doing a repetition of a forearm wrist curl with the weight training apparatus of the present invention.
Figure 7:
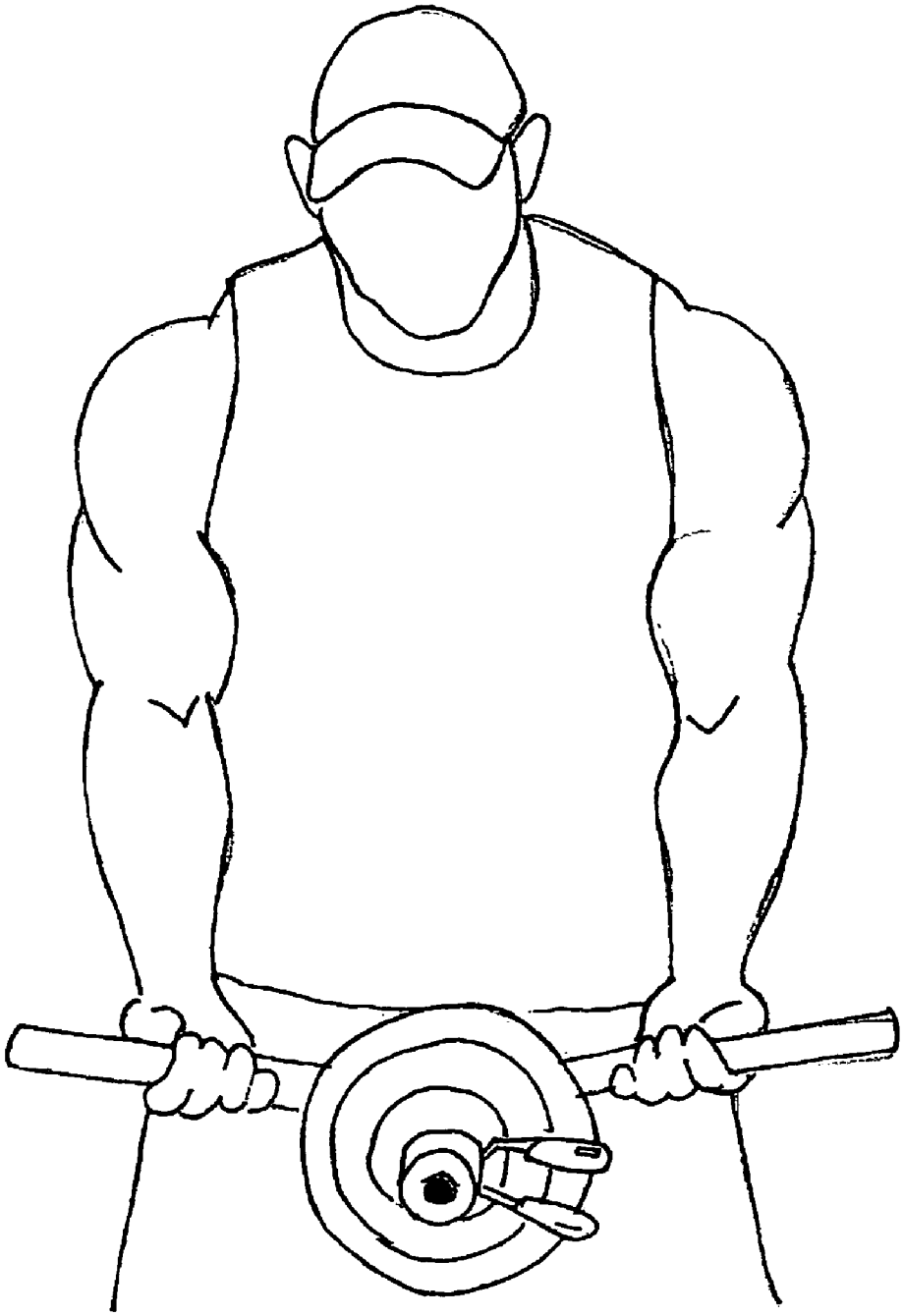
FIG. 7 is a perspective view showing a user doing a repetition of a wrist curl with the weight training apparatus of the present invention.

Preferably the handles 14 are somewhat elongated so as to enable the user to position his hands at varying distances apart within a relatively wide range to accommodate the user as to the type of exercise desired. In addition, and to add a further measure of flexibility, comfort and in order to stress the forearm muscles and wrist flexors from different angles, obtusely angled (FIG. 7) or acutely angled (FIG. 6) the handles 14 and connection portion 18 to the central collar 12 may comprise an angle in the range of between about 2 degrees and about 10 degrees.

Figure 5:
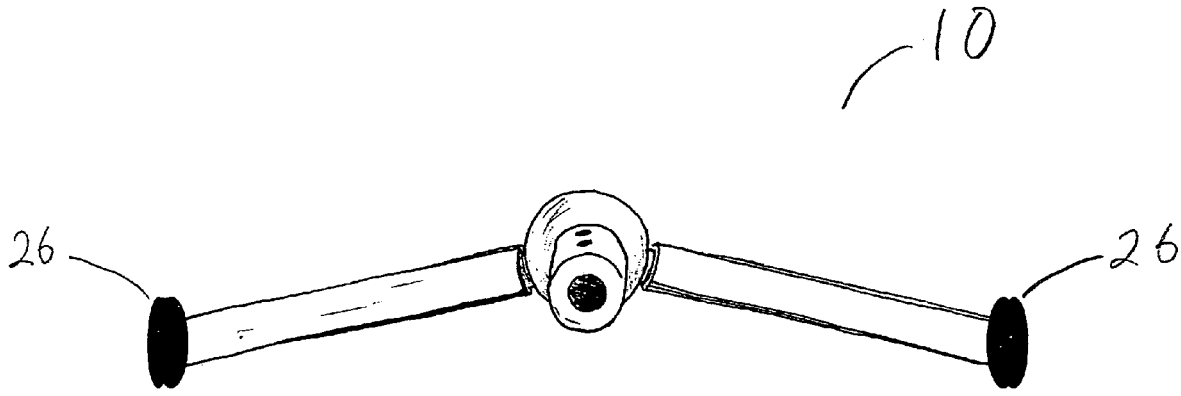
FIG. 5 is a perspective view of the weightlifting apparatus of the present invention with cylindrical protrusions installed thereon.
Figure 8:
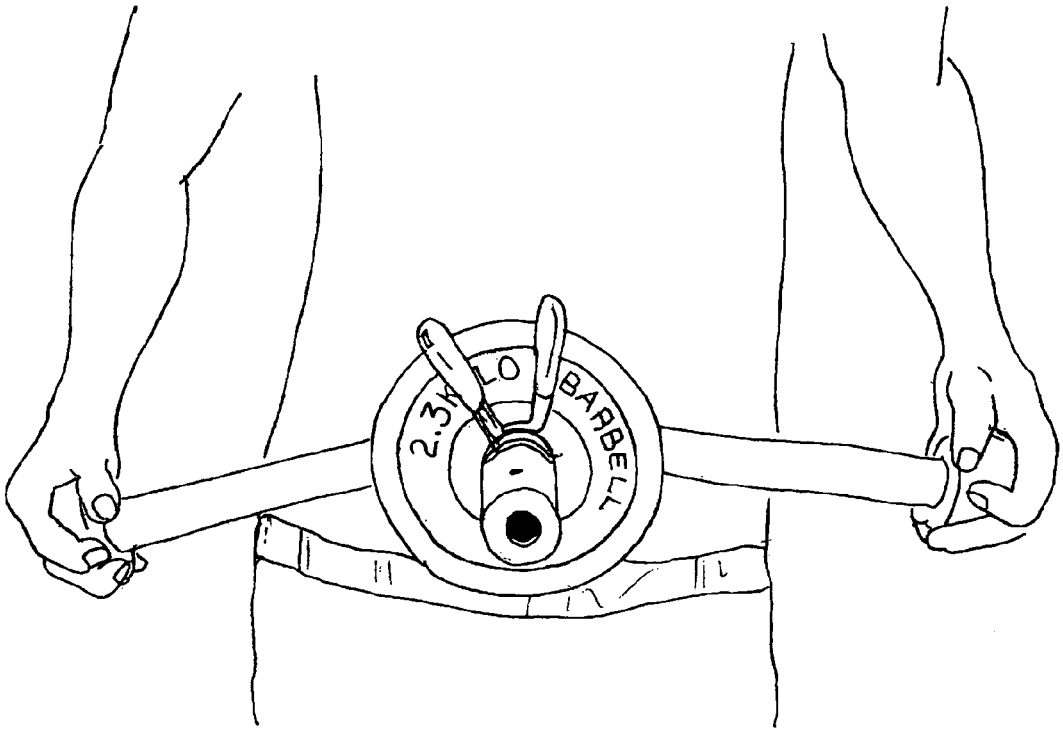
FIG. 8 is a perspective view showing a user doing a repetition of a wrist curl with the weight training apparatus of the present invention.

Preferably the handles 14 are provided with cylindrical protrusions 26 to enable a user to grip the handles 14 with the palms of the gripping hands facing inward, as illustrated in FIG. 5 and FIG. 8

Figure 4:
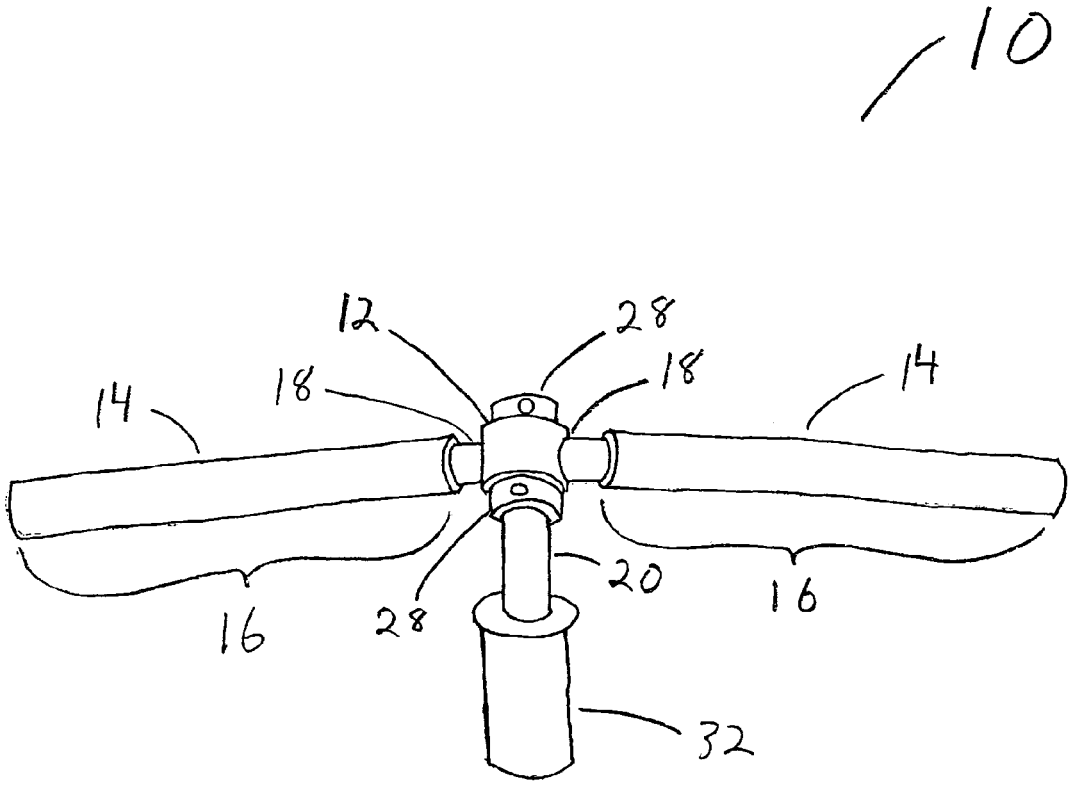
FIG. 4 is a perspective view of the weightlifting apparatus of the present invention with 35 degree angled weight support attachment installed thereon using shaft collars.

As shown in the FIGS. 2–4 the weight training apparatus 10 may be provided with a pivotal weight support attachment. Preferably, weight support attachment 20 may comprise an angle in the range of between about 10 degrees, and about 45 degrees. Preferably, the weight support attachment 20, is comprised of a steel bar having a circular cross-section and an outer diameter of about 1 inch in order to accept weight plates with a one inch hole. In another preferred embodiment weight support attachment 20 may be fitted with a sleeve 32, preferably the sleeve 32, is comprised of a steel bar having a circular cross-section and an outer diameter of about 2 inch in order to accept weight plates with a two inch hole As illustrated in FIGS. 2, 3, and 4; Weight support attachment 20 is received into the central collar 12 substantially at its midpoint. Preferably, central collar 12 includes a through hole opening 22, to receive a hitch pin 24 or similar device, so that the weight support attachment 20 may be pivoted in a substantially upwardly or downward position as desired by user and secured in central collar 12 as shown in FIG. 2, in order to accept weight plates or to allow the user to remove the weight support attachment 20, as desired. In another preferred embodiment weight support attachment 20, is secured in the central collar 12 using shaft collars 28 as illustrated in FIG. 4. Obviously, there are several methods of attaching the weight support attachment 20 to the central collar 12 such as welding, casting the components as one integral piece, linking the various members with threaded connectors, or any other suitable manner as known in the art. Ball bearings may be used in the central collar 12 for efficient rotation of weight support attachment 20; Weights may be retained by a sliding collar or similar means on the angled weight support attachment.

In addition, as shown in FIGS. 2 and 3, weights may be releasably retained on the angled weight support attachment 20 by means of any suitable retaining device know in the art, such as the stop washer 30 shown, which may serve to prevent the weights from being displaced from the desired positions.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated.

What is claimed is:

1. A weight training apparatus comprising:

a central collar comprising a ring having a perimeter and a central aperture;

a pair of elongate handles, each elongate handle having a connecting end portion at a proximal end thereof and a gripping portion at a distal end thereof;

each of said pair of elongated handles extending from the perimeter of said ring such that a longitudinal axis of each of said elongate handles is angled relative to one another;

each of said elongate handles having protrusions connected at distal ends thereof allowing a user to grip said apparatus with the palms of the hands aligned vertically;

an elongated angled weight support attachment having a weight support attachment end selectively inserted into said central aperture of said central collar, and a sleeve extending from said weight support attachment end at an angle such that said elongated angled weight support attachment can be selectively pivoted into a substantially upwardly oriented position or selectively pivoted to a substantially downwardly oriented position;

said elongated angled weight support attachment having an angled bend between said weight support attachment end and said sleeve; and wherein weight plates may be selectively supported on said sleeve of said elongated angled weight support attachment, whereby a user grasps said gripping portions of said pair of elongated handles for a desired exercise.

2. The weight training apparatus of claim 1, wherein said elongated angled weight support attachment is secured to said central collar by a removable pin extended through a pair of openings in the perimeter of said ring of said central collar and through an opening in said weight support attachment end.

3. The weight training apparatus of claim 1, wherein said elongated handles extend from said central collar at an angle in the range of between 2 degrees and 10 degrees.

4. The weight training support apparatus of claim 1, wherein said angled bend of said elongated angled weight support attachment is in the range of between 10 degrees and 45 degrees.

* * * * *